United States Patent [19]

Murata

[11] 4,173,354

[45] Nov. 6, 1979

[54] SKI BRAKING DEVICE

[75] Inventor: Masahiro Murata, Matsudo, Japan

[73] Assignee: Hope Co., Ltd., Tokyo, Japan

[21] Appl. No.: 893,307

[22] Filed: Apr. 4, 1978

[30] Foreign Application Priority Data

Apr. 11, 1977 [JP] Japan ..... 52/40464

[51] Int. Cl.[2] ..... A63C 7/10

[52] U.S. Cl. ..... 280/605

[58] Field of Search ..... 280/605, 604; 188/5

[56] References Cited

U.S. PATENT DOCUMENTS

| | | | |
|---|---|---|---|
| 4,014,563 | 3/1977 | Weigl et al. | 280/605 |
| 4,062,562 | 12/1977 | Riedel | 280/605 |
| 4,101,145 | 7/1978 | Korger | 280/605 |

*Primary Examiner*—David M. Mitchell

*Attorney, Agent, or Firm*—Wenderoth, Lind & Ponack

[57] ABSTRACT

A ski braking device includes a spring wire, the front portion of which extends along the side edge of a ski plate and which is extensible below the lower surface of the ski plate, the intermediate portion of which is rotatably supported on a mounting plate, and the rear end portion of which is elastically bent and slidably provided in a guide cavity in a pedal member. The pedal member is movably connected to the mounting plate in such a manner that when the pedal member is pushed down, the pedal member is moved relative to the rear end portion of the spring wire to deform the bent shape thereof and to allow an elastic strain energy to be retained at the deformed rear end portion thereof.

8 Claims, 6 Drawing Figures

SKI BRAKING DEVICE

BACKGROUND OF THE INVENTION

This invention relates to a ski braking device for preventing runaway of a ski plate in the event that a ski boot is disengaged therefrom and, more particularly, to a ski braking device which is operated by an elastic force of a spring wire.

Many proposals have previously been made hitherto to provide a ski braking device using a spring wire. However, many of the ski braking devices of this type are formed by bending the spring wire into a complicated shape in order that an elastic strain energy of the spring wire may be retained therein when it is pushed down by a sole of a ski boot. Accordingly, due to the complicated shape of the spring wire, special attention had to be paid to the accuracy of the dimensions of each of the bent portions, and also the total length of the spring wire to be used was relatively long, thus causing an increase of the manufacturing costs.

On another hand, in the other known ski braking device in which the spring wire or wires are bent in a relatively simple shape, relatively wide slots or guide spaces are formed in a mounting plate for supporting the spring wire on a ski plate. These slots or guide spaces in the mounting plate are required for the movement of the spring wire from one inoperative position to the other operative braking position, but allow the snow or mud attached on the sole of the ski boot to enter therein and to become frozen thereat, with the result that the desired operation of the ski braking device is disturbed.

SUMMARY OF THE INVENTION

Accordingly, an object of the present invention is to provide a ski braking device which is simple in structure and reliable in operation.

Another object of the present invention is to provide a ski braking device using a spring wire in which a portion of the spring wire which retains an elastic strain energy therein in an inoperative position is concealed to provide a good external appearance of the device.

Still another object of the present invention is to provide a ski braking device using a spring wire having a short length to reduce the manufacturing cost of the device.

A ski braking device according to the present invention comprises a spring wire, the front portion of which extends along the side edge of a ski plate and which is extensible below the lower surface of the ski plate, the intermediate portion of which is rotatably supported relative to the ski plate, and the rear end portion of which is elastically bent. The intermediate portion of the spring wire is rotatably supported on a mounting plate adapted to be attached to the ski plate. The rear end portion of the spring wire is slidably engaged within a guide cavity in a pedal member. The pedal member is movably connected with the mounting plate in such a manner that when the pedal member is pushed down by a sole of a ski boot, the pedal member is moved relative to the rear end portion of the spring wire to deform the bent shape thereof and to allow an elastic strain energy to be retained at the deformed rear end portion thereof.

Preferably, the rear end portion of the spring wire is bent substantially in the shape of a "U" or "V", and the guide cavity in the pedal member is formed substantially in the shape of a "U" or "V" which is slightly larger than the U-shaped or V-shaped rear end portion of the spring wire.

The rear end portion of the spring wire may have an elastic force tending to expand outwardly or to contract inwardly in the cavity of the pedal member. In this case, the pedal member is connected to the mounting plate so as to move against the elastic force of the rear end portion of the spring member when pushed down toward the inoperative position.

Other objects and features of the present invention will become apparent from the detailed description of preferred embodiments thereof when taken in conjunction with the accompanying drawings, in which:

DETAILED DESCRIPTION OF THE INVENTION

Figure 1:
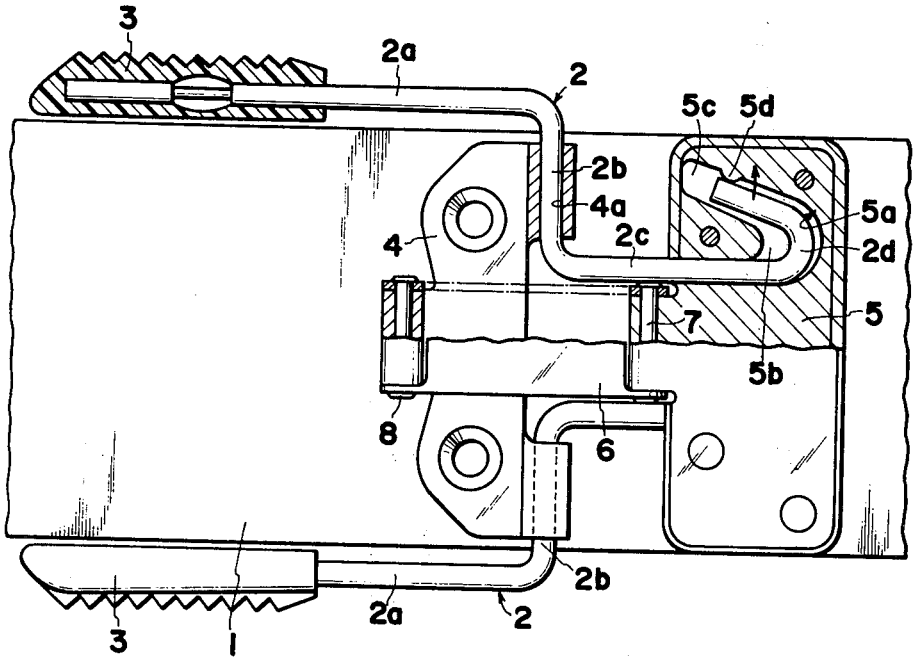
FIG. 1 is a partially sectioned plan view showing a ski braking device according to an embodiment of the present invention, wherein the device is at the inoperative position.

Referring now to a first embodiment of the present invention shown in FIGS. 1 through 4, a ski braking device comprises a pair of spring wires 2—2 provided at both sides or edges of a ski plate 1 symmetrical relative to a longitudinal center line of the ski plate 1. Each spring wire 2 has a shank 2*a* at the front portion thereof which extends along an edge of the ski plate 1 and is covered at the front end portion thereof with a plastic braking element 3 provided with sawteeth. The spring wire 2 is bent substantially at right angles relative to the longitudinal direction of the ski plate 1 at the intermediate portion 2*b* thereof and rotatably supported in a respective lateral bore 4*a* of a mounting plate 4 which is secured on the ski plate 1. The rear portion 2*c* of each spring wire 2 is then bent substantially at right angles relative to the intermediate portion 2*b* thereof parallel to the longitudinal direction of the ski plate 1. The rear end portion 2*d* of the spring wire 2 is bent outwardly substantially in the shape of a "U" or "V".

This bent end portion 2*d* of each wire 2 has such a spring force tending to expand outwardly as shown by an arrow in FIG. 1 and is slidably confined under compression in a guide cavity 5*a*, which is formed in a pedal member 5 substantially in the shape of a "U" or "V" and which is covered by upper and lower plates. Each guide cavity 5*a* has a bight portion 5*b* and an end extension 5*c*, which are slightly larger than the bent end portion 2*d* of the spring wire 2 to allow the pedal member to slide forwardly and rearwardly relative to the bent end portions 2*a*—2*d* of the spring wire. Preferably, a semi-spherical projection 5*d* is provided at the outer side wall of each guide cavity 5*a* in contact with the terminal rear end of the spring wire 2 in such a manner that when the pedal member 5 is moved forwardly relative to the rear end of the spring wire, the projection 5*d* can effectively compress the rear end 2*d* of the spring wire 2.

The pedal member 5 is rotatably connected at the front center end thereof to the rear end of an arm 6 by a pin 7. The arm 6 is also rotatably connected at the front end thereof to the front end of the mounting plate 4 by a pin 8, so that the rotatably supported intermediate portion 2*b* of the spring wire is located between the two pins 7 and 8 at opposite ends of the arm 6 as clearly shown in FIGS. 1 and 2. Preferably, a line which connects the axial centers of the pins 7 and 8 at the opposite ends of the arm 6 should be located above a line which connects the axial centers of the pin 8 and the rotatably supported intermediate portion 2*b* of the spring wire 2. More preferably, a leaf spring 9 or such elastic member is interposed between the mounting plate 4 and the arm 6 in order that the line connecting the pins 7 and 8 can take a upper position relative to the line connecting the pin 8 and the intermediate portion 2*b* of the spring wire immediately after a ski boot (not shown) pushing down the pedal member 5 is removed therefrom.

Figure 2:
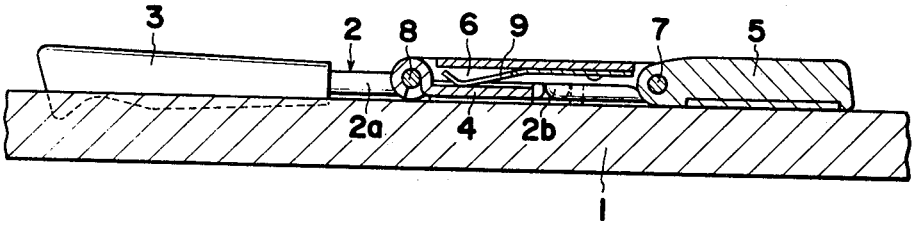
FIG. 2 is a partially sectioned side view of the ski braking device in FIG. 1.
Figure 3:
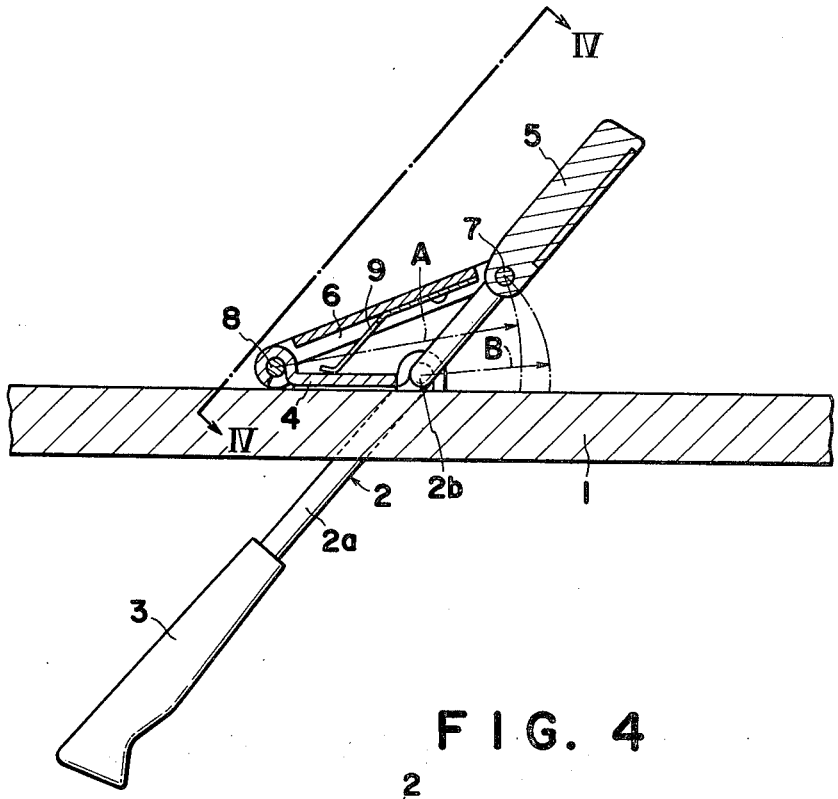
FIG. 3 is a partially sectioned side view of the same ski braking device at the operative braking position.
Figure 4:
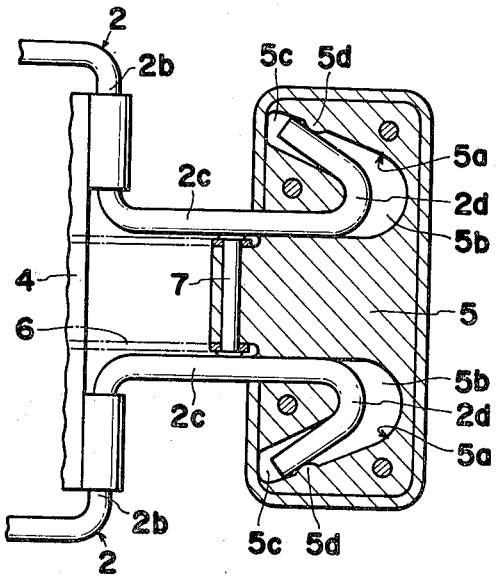
FIG. 4 is a fragmentary view looked along the line IV—IV in FIG. 3 but partially sectioned to show the internal structure of the pedal member.

In such a structure of the ski braking device of the first embodiment, when the shanks 2*a*—2*a* of the spring wires 2—2 extend downwardly beyond the lower surface of the ski plate 1 and take the operative braking positions as shown in FIG. 3, the pedal member 5 is at the retracted position rearwardly shifted relative to the bent rear portions 2*d*—2*d* of the spring wires 2—2, whereby the bent rear portions 2*d*—2*d* of the spring wires are relatively open or expanded in the sidewise directions in the guide cavities 5*a*, as shown in FIG. 4. Then, when the pedal member 5 at the position in FIGS. 3 and 4 is pressed down by the sole of the ski boot, the pedal member 5 slides forwardly relative to the rear bent portion of the spring wire 2, because the arm 6 is arranged such that the locus of the pin 7 formed by the radius of rotation (A) about the pin 8 is drawn at the front inner side of the locus of a spring wire point, which is adjacent to the pin in FIG. 3, formed by the radius of rotation (B) about the intermediate portion 2*b* of the spring wire. The sliding movement of the pedal member 5 is allowed due to the guide cavities 5*a*—5*a* of the pedal member 5 which have larger spaces than the dimensions of the bent rear end portions 2*d*—2*d* of the spring wires. Thus, when the pedal member 5 slides relative to the bent rear end portions 2*d*—2*d* of the spring wires, the semi-spherical projections 5*d*—5*d* at the guide cavities further compress the terminal rear ends of the spring wires against the expansible spring force thereof, whereby the spring wires 2—2 take the inoperative position shown in FIGS. 1 and 2 with elastic strain emergy being retained therein.

On the other hand, when the depressing force having been applied on the pedal member 5 in the position shown in FIGS. 1 and 2 is removed, for example, by disengagement of the ski boot therefrom, an elastic force is generated on the bent end portions 2*d*—2*d* of the spring wire 2 so as to move the pedal member 5 rearwardly by sidewise expansion thereof. At this time, since the line connecting the pins 7 and 8 at the opposite ends of the arm 6 is located above the line connecting the forward pin 8 and the intermediate portion 2*b* of the spring wire 2, the vertical component of the elastic force generated at the bent end portion 2*d* of each spring wire causes the spring wire 2 to rotate about the intermediate portion 2*b* thereof. At the time of rotation of each spring wire 2, since the guide cavity 5*a* in the pedal member 5 has a space larger than the dimension of the bent rear end portion 2*d* of the spring wire, and also since the radius of rotation (A) of the arm 6 about the pin 8 is different from that (B) of the spring wire about the intermediate portion 2*b* thereof, the pedal member 5 is moved rearwardly to the position shown in FIGS. 3 and 4 where the shank 2*a* of each spring wire inclines beyond the lower surface of the ski plate and partially penetrates into the snow to prevent the ski from running away.

Figure 5:
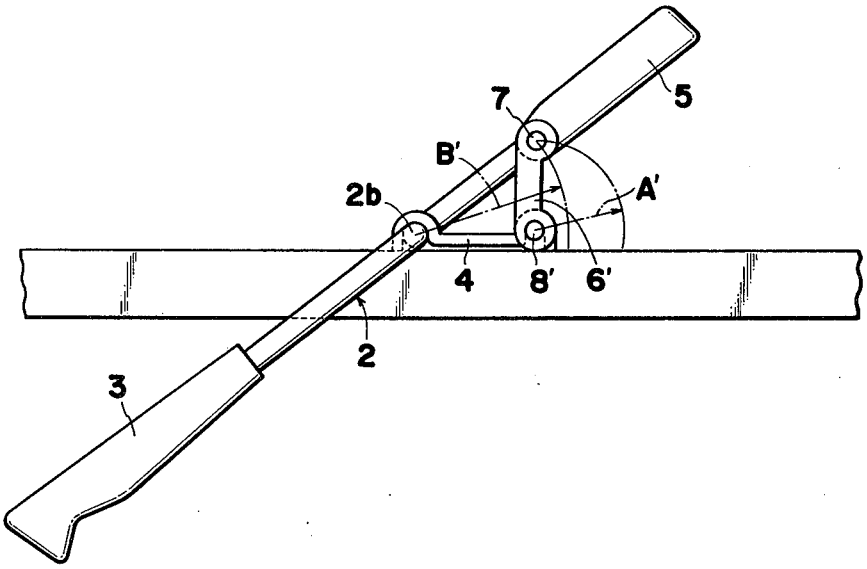
FIG. 5 is a side view showing another embodiment of a ski braking device of the present invention, wherein the device is at the operative braking position.
Figure 6:
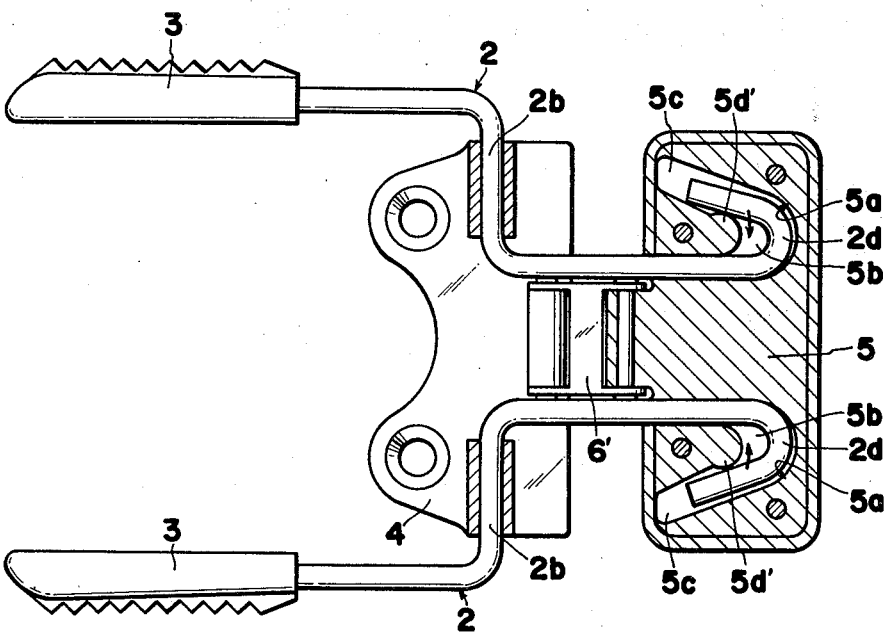
FIG. 6 is a partially sectioned plan view of the device shown in FIG. 5.

Reference is now made to a second embodiment of the present invention shown in FIGS. 5 and 6. In the second embodiment, different from the first embodiment set forth above, an arm 6′ is rotatably connected at one end thereof to the rear end of the mounting plate 4 by a pin 8′ and at the other end thereof to the pedal member 5. The arm 6′ is arranged such that the locus of the pin 7 formed by the radius of rotation (A′) about the pin 8′ is drawn at the rear outer side of the locus of a spring wire point, which is adjacent to the pin 7 in FIG. 5, formed by the radius of rotation (B′) about the intermediate portion 2*b* of the spring wire 2. Accordingly, the pedal member 5 is forced to slide rearwardly. The rearward sliding movement of the pedal member 5 is allowed by the slidable engagement of the bent rear end portions 2*d*—2*d* of the spring wires 2—2 with the guide cavities 5*a*—5*a*, respectively, as in the case of the first embodiment. However, in the second embodiment, the bent rear end portions 2*d*—2*d* of the spring wires are located at the rear end parts of the guide cavities at the braking position shown in FIGS. 5 and 6 and have a spring force tending to contract inwardly as shown by arrows in FIG. 6, the direction of which is opposite to that shown in the first embodiment in FIG. 1. Accordingly, it is preferable to provide a semi-spherical projection 5*d*′ at each inner wall of the guide cavity in contact with the inner bent rear end of the spring wire.

In such a construction of the second embodiment of the present invention, when the pedal member 5 in the braking position shown in FIGS. 5 and 6 is pushed down or depressed by the sole of the ski boot, the pedal member 5 is moved rearwardly and forcedly opens the bent rear end portions 2*a*—2*d* of the spring wires 2—2 against the inwardly contracting force thereof, whereby the bend rear end portions of the spring wires retain the elastic strain energy therein at the depressed position of the pedal member 5.

The other structural and operational of the second embodiment are substantially the same as those mentioned with respect to the first embodiment.

As will be understood from the disclosure of the embodiments of the present invention set forth above, since the elastic force of the spring wire which actuates the shank thereof is generated at the rear end portion of the spring wire, no conventional structure such as to complicatedly bend or fold the spring wire at the middle portions thereof is necessitated. Accordingly, no special accuracy of the dimensions of the spring wire is required at the bent portions of the spring wire. In addition, since the length of the spring wire can be shorter, the present brakig device becomes compact and the manufacturing cost thereof can be reduced. Furthermore, the bent rear end portion of the spring wire engageable with the guide cavity is confined in and covered by the pedal member, so that the spring wire appearing on the ski plate can be linear with good appearance and that the operation of the present ski braking device is reliable without any possibility that the snow or soil can enter into the guide cavity in the pedal.

Although the present invention has been described with reference to preferred embodiments thereof, many modifications and alterations may be made within the scope of the present invention.

What is claimed is:

1. A ski braking device comprising a spring wire, the front portion of which extends along a side edge of a ski plate and is extensible below the lower surface of said ski plate, the intermediate portion of which is rotatably supported relative to said ski plate, the rear end portion of which is elastically bent, a mounting plate adapted to be attached on said ski plate and rotatably supporting said intermediate portion of said spring wire, a pedal member having a guide cavity therein in which said rear end portion of said spring wire is slidably provided, and an arm member pivotably connected to said pedal member and to said mounting plate at positions spaced from the rotatable support of the intermediate portion, such that when said pedal member is pushed down by a sole of a ski boot, said pedal member is moved relative to said rear end portions of said spring wire to deform the bent shape thereof and to allow an elastic strain energy to be retained at the deformed rear end portion thereof.

2. A ski braking device as claimed in claim 1, wherein said rear end portion of said spring wire is bent substantially in the shape of a "U" or "V", and said guide cavity in said pedal member is formed substantially in the shape of a "U" or "V" which is slightly larger than the U-shaped or V-shaped rear end portions of said spring wire.

3. A ski braking device as claimed in claim 1, wherein said rear end portion of said spring wire has an elastic force tending to expand outwardly in said cavity of said pedal member, and said pedal member is moved in a direction to further bend said rear end portion of said spring wire when it is pushed down.

4. A ski braking device as claimed in claim 1, wherein said rear end portion of said spring wire has an elastic force tending to contract inwardly, and said pedal member is moved in a direction to expand said rear end portion of said spring wire when it is pushed down.

5. A ski braking device as claimed in claim 2, wherein said guide cavity has a projection on a side wall thereof which acts upon the terminal end of said rear end portion of said spring wire to facilitate the deformation thereof when said pedal member is pushed down.

6. A ski braking device as claimed in claim 1, further comprising a second spring wire which is provided at an opposite side edge of said ski plate and symmetrically to the first mentioned spring wire relative to the longitudinal center line of said ski plate, said second spring wire having substantially the same structure as said first-mentioned spring wire.

7. A ski braking device as claimed in claim 3, wherein said arm member is rotatably connected at one end thereof to said pedal member and at the other end thereof to said mounting plate in front of the portion thereof where said intermediate portion of said spring wire is rotatably supported.

8. A ski braking device as claimed in claim 4, wherein said arm member is rotatably connected at one end thereof to said pedal member and at the other end thereof to said mounting plate at the rear of the portion thereof where said intermediate portion of said spring wire is rotatably supported.

* * * * *